United States Patent [19]

Tajima

[11] Patent Number: 4,622,697

[45] Date of Patent: Nov. 18, 1986

[54] SKI PANTS COVER

[75] Inventor: Kazuhiko Tajima, Tokyo, Japan

[73] Assignee: Phenix Co., Ltd., Tokyo, Japan

[21] Appl. No.: 714,753

[22] Filed: Mar. 22, 1985

[30] Foreign Application Priority Data

Mar. 27, 1984 [JP] Japan ..... 59-042691[U]

[51] Int. Cl.[4] ..... A41D 13/00

[52] U.S. Cl. ..... 2/23; 36/2 R; 2/62; 2/242

[58] Field of Search ..... 2/242, 62, 227, 269, 2/23, 22; 36/2 A, 2 B, 1.5

[56] References Cited

U.S. PATENT DOCUMENTS

| | | | |
|---|---|---|---|
| 1,749,231 | 3/1930 | Sager | 36/2 B |
| 1,749,789 | 3/1930 | Wheeler | 36/2 |
| 1,922,172 | 8/1933 | Nilsen | 36/2 B |
| 2,568,083 | 9/1951 | Mitchell | 2/23 |
| 2,835,990 | 5/1958 | Lang | 36/2 |
| 3,191,185 | 6/1965 | Martin | 2/242 |

FOREIGN PATENT DOCUMENTS

| | | | |
|---|---|---|---|
| 802581 | 1/1951 | Fed. Rep. of Germany | 2/62 |
| 1176119 | 4/1959 | France | 2/227 |
| 2467556 | 5/1981 | France | 2/23 |
| 208342 | 4/1930 | Switzerland | 36/2 |
| 458253 | 8/1968 | Switzerland | 2/227 |
| 511414 | 8/1939 | United Kingdom | 2/227 |

*Primary Examiner*—Ronald Feldbaum

*Attorney, Agent, or Firm*—Armstrong, Nikaido, Marmelstein & Kubovcik

[57] ABSTRACT

A ski pants cover comprising a ski pant provided at the upper portion of the knee with a first retaining piece adapted to mount a cover at the ankle portion with likewise a second retaining piece for mounting the cover, said first retaining piece being hidden by a fly-front and the cover formed in such a manner as that a knee abutting portion, a shin abutting portion and a calf abutting portion are integrally connected each other and extendable, and characterized in that at the upper end of said knee abutting portion of said cover is provided with a third retaining piece adapted to engage the first retaining piece provided on the upper portion of the knee, and at the external ends of said shin abutting portion and said calf abutting portion of said cover are provided with fourth and fifth engaging pieces for engagement at a time when the cover is wound around the ski pant respectively and furthermore, at the ankle portion of said cover is provided with a sixth retaining piece adapted to engage the second retaining piece provided at the ankle portion of the ski pant.

6 Claims, 3 Drawing Figures

SKI PANTS COVER

BACKGROUND OF THE INVENTION

This invention relates to ski pants covers detachably put on ski pants.

Generally, ski pants are prepared in a triplex structure as follow, in view of cold-proofing and water repellency against snow and also for good functions. That is, ski pants are formed of a front cloth made of water repellent material, a heat retaining material which is coated with plastic material for water repellency and heat retaining purpose, and a lining cloth having elastic property for smooth insertion of the foot when put on. And in recent years, at the stage of designing ski pants, it came to be regarded very important that consideration is given not only to the pursuit of performance but also to fashionability and colors.

By the way, it is usual practice that ski pants are made of comparatively thick cloth and sewn rigidly. Because of the foregoing, the ski pants themselves cannot be worn in a reversible manner. Accordingly, it was almost impossible to change colors with ease, designs, etc. in accordance with necessity by using only one pair of ski pants.

SUMMARY OF THE INVENTION

The present invention is acomplished in view of the above mentioned points. It is therefore an object of the present invention to provide ski pants covers, wherein detachable covers are provided on the generally upper portions of the knees to the bottom portions of the ski pants, thereby rendering several kinds of color variations to one pair of ski pants in order to increase the fashionability and saving the labor to remove snow attached on during skiing in view of functional reason.

DETAILED DESCRIPTION OF THE EMBODIMENT

Figure 1:
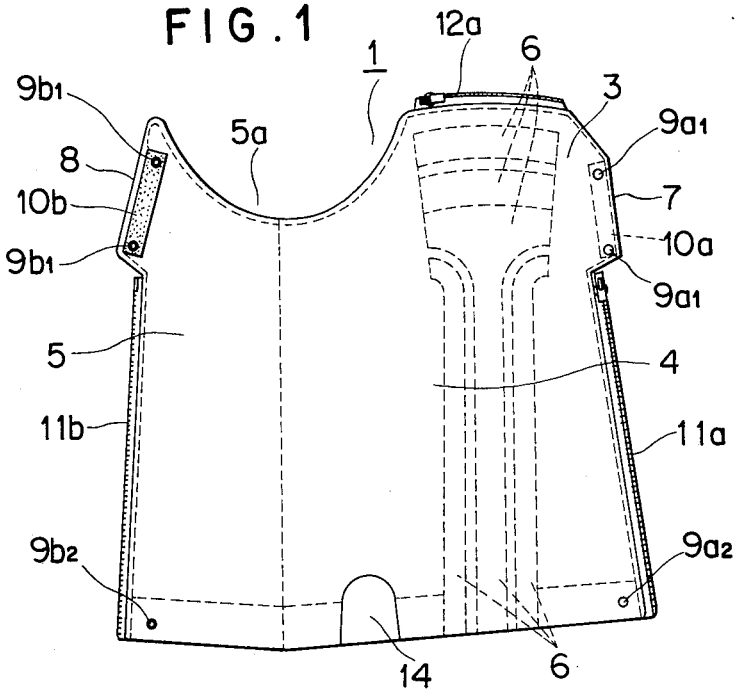
FIG. 1 is a development view of a ski pants cover according to the present invention.
Figure 3:
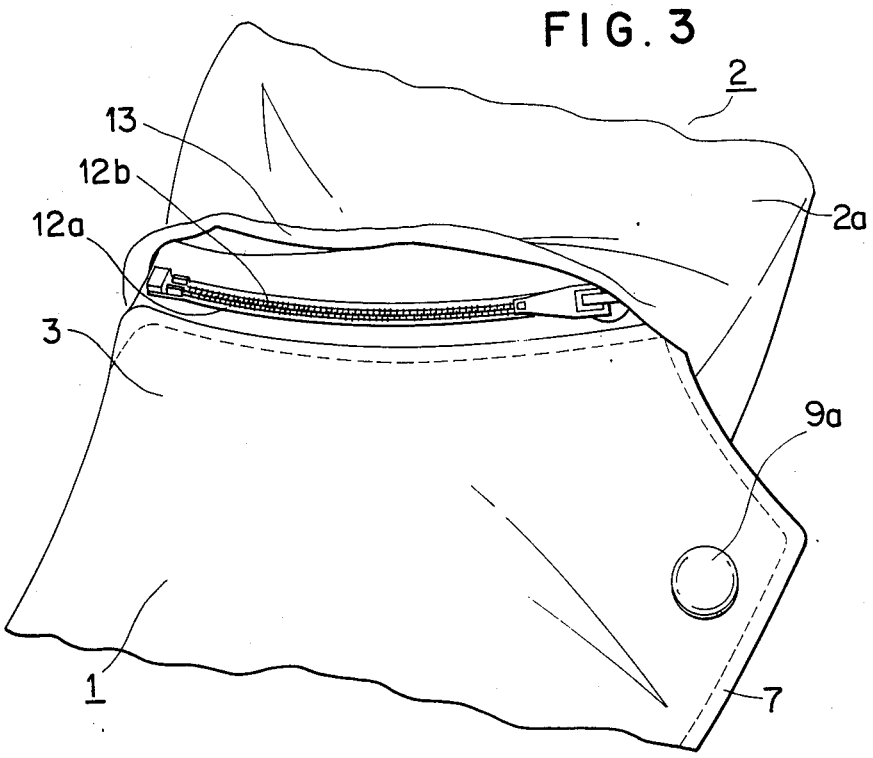
FIG. 3 is likewise an enlarged perspective view of the cover attached to the ski pants.

One embodiment of the present invention will be described with reference to the drawings. Although such covers are actually used as a pair, explanation of only one of the pair will be sufficient since the structure of them is symmetric with each other.

1 denotes a cover and 2 denotes ski pants composed of a front body and a rear body, on which the cover 1 is detachably put.

Said cover 1 is made of generally same material as that of the ski pants 1. That is, a knee abutting portion 3, a shin abutting portion 4 and a calf abutting portion 5 are formed of outer cloth, heat retaining material and lining cloth in such a manner as to be integrally connected to each other and extendable. The front cloth has different colors from those of the ski pants cover 1. A fluorescent paint may be applied to the front cloth of the cover 1 as a safety mark for skiing at night.

6 denotes core material interposed between said front cloth and said heat retaining material. Said core material is arranged horizontally, particularly at the knee abutting portion 3 and vertically at the shin abutting portion 4 in several rows respectively for easy bending and stretching movement. This core material 6 is formed of cushioning material such as urethane rubber and felt and adapted to protect the knee and the shin. 5*a* denotes a depressed portion formed in order to facilitate the back of the knee to be bent or stretched easily. 7 and 8 denote ears for engagement projecting from the outer side edges of said knee abutting portion 3 and the shin abutting portion 5 when the cover 1 is wound around the ski pants 2. Said connecting ears 7 and 8 are provided with several male and female hooks $9a_1$ and $9b_1$ and magic tapes 10*a* and 10*b* (merchandise name). When the engaging ears 7 and 8 are abutted each other, the hooks $9a_1$ and $9b_1$, and the magic tape 10*a* and 10*b* become freely engagable and disengagable each other. $9a_2$ and $9b_2$ denote disengagable male and female hooks provided at the bottom portion 2*b* of the cover.

11*a* and 11*b* denote halves of fastener for engagement provided at vertical side edges of the shin abutting portion 4 and the calf abutting portion 5 beneath the coupling ears 7 and 8.

12*a* denotes a half of fastener provided at the upper edge of said cover 1. Said fastener half 12*a* is engagable with another fastener half 12*b* provided at a generally upper portion 2*a* of the knee of the front body of said ski pant 1. 13 denotes a fly-front provided at the generally upper portion 2*a* of the knee in such a manner as to hide said fastener halves 12*a* and 12*b* therein. 14 denotes a protection piece formed of flexible material such as rubber or leather, and adapted to prevent wear at the bottom portion 2*b* of the ski pants 2 at a time when said cover 1 is wound therearound, said protection piece 14 being bonded to the inner side of the cover 1.

Figure 2:
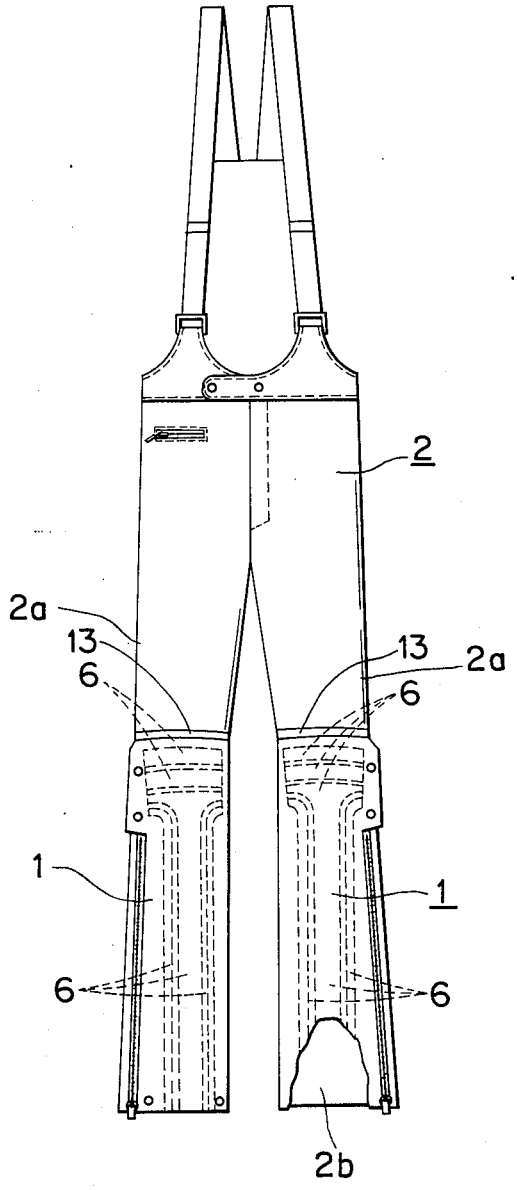
FIG. 2 is a front veiw, partly cut away, of the above when in use.

One embodiment of the present invention is constituted as in the above mentioned manner. With this constitution, in order to put the cover 1 on the ski pants, the fastener half 12*a* provided at the upper edge thereof is engaged with the fastener half 12*b*. Simultaneously, the fastener half 11*a* provided at the shin abutting portion 3 of the cover 1 is engaged with the fastener half 11*b* provided at the calf abutting portion 5 of the cover 1. Furthermore, the male and female hooks $9a_1$ and $9b_1$ as well as the magic tapes 10*a* and 10*b* provided at the coupling ears 7 and 8 respectively are engaged each other. In this way, as shown in FIG. 2, the cover 1 is wound around from the upper portion 2*a* to the bottom portion 2*b* and is put on the bottom portion 2*b* of the ski pants 2. Likewise, as shown in FIG. 1, in order to remove the cover 1 from the ski pants 1, the fastener half 12*a* is disengaged from the fastener half 12*b*. At the same time, the fastener half 11*a* is disengaged from the fastener half 11*b* and the magic tape 10*a* is detached from the magic tape 10*b*. Furthermore, the hooks $9a_1$ are disengaged from the corresponding hooks $9b_1$.

In this embodiment, although the cover 1 is constituted in such a structure as to be merely detachable, it can be reversibly attached to the ski pants 2 from the generally upper portion of the knees and the bottom portions by using double faced fastener halves 12*a*; 11*a* and 11*b*, hooks $9a_1$ and $9b_1$, and magic tapes 10*a* and 10*b* in order to increase fashionability. Although the fasteners and hooks are employed as retaining means for the cover 1 and the ski pants 2 in this embodiment, other suitable retaining means may be employed.

As described in the foregoing, according to the present invention, since the cover, which is formed in such a manner as that the knee abutting portion, the shin abutting portion and the calf abutting portion are integrally connected together and are extendable, is painted in different colors from those of the ski pants, or is painted with fluorescent material in order to wind it around from the generally upper portion of the knee to the ankle portion of the ski pants in a detachable manner, one pair of ski pants can be enjoyed in several ways in view of the fashion by preparing several covers having different hue and using them in turn. In case where the fluorescent cover is used, safe skiing at night will be ensured since the fluorescent color serves as a safety mark. Moreover, the ski pant is protected in duplex from the generally upper portion of the knee and the ankle portion. Therefore, even if it snows during skiing, a skier who wears the ski pants with said covers will be fully protected from cold. Snow can be easily removed by detaching the covers unlike in the case with the prior art where additional time and labor are required for its removal. In addition, since the ski pants on which the covers are put are not specially different from the conventional ones, low costs can be obtained.

What is claimed is:

1. A ski pants cover for covering ski pants, composed of a front body and a rear body, from a knee portion to an ankle portion thereof, said ski pants cover comprising:

a knee abutting portion adapted to abut against a knee portion of the ski pants and to cover said knee portion;

a shin abutting portion connected to said knee abutting portion to abut against a shin portion of the ski pants and to cover said shin portion; and a calf abutting portion connected to said shin abutting portion to abut against a calf portion of the ski pants when said ski cover is attached around the ski pants, said calf abutting portion having a depressed portion at the top thereof to allow free movement and bending of the knee, said shin abutting portion and said calf abutting portion being adapted to be extended to provide two vertical side edges;

said ski pants cover being provided with first engaging means at an upper portion of the knee abutting portion for attaching said knee attaching portion to a point above the knee portion in the front body of the ski pants, second engaging means at a lower portion of the knee abutting portion for attaching said shin attaching portion and the calf attaching portion at the front body and the rear body of the ski pants, and third engaging means at said outer vertical side rims for engaging said shin attaching and the calf attaching portion with each other.

2. A ski pants cover according to claim 1, wherein said first engaging means includes a fastener.

3. A ski pants cover according to claim 1, wherein said second engaging means includes hooks.

4. A ski pants cover according to claim 1, wherein said ski cover has a color different from the ski pants.

5. A ski pants cover according to claim 1, wherein said first, second and third engaging means are of double face type such that said ski pants cover functions as a reversible type.

6. A ski pants cover according to claim 1, wherein said cover includes a core cushioning material extending from an upper part of said knee abutting portion to a lower part of said shin abutting portion for protecting the knee and shin.

* * * * *